United States Patent [19]

Rathert et al.

[11] 4,285,292

[45] Aug. 25, 1981

[54] METHOD OF THREAD STITCHING LAYERS TO FORM A SEWN BOOK

[75] Inventors: Horst Rathert, Minden; Winfried Hedrich, Rahden, both of Fed. Rep. of Germany

[73] Assignee: Rahdener Maschinenfabrik August Kolbus, Wesphalia, Fed. Rep. of Germany

[21] Appl. No.: 114,074

[22] Filed: Jan. 21, 1980

Related U.S. Application Data

[62] Division of Ser. No. 8,697, Feb. 1, 1979, Pat. No. 4,252,071.

[30] Foreign Application Priority Data

Feb. 14, 1978 [DE] Fed. Rep. of Germany ..... 2806062

[51] Int. Cl.[3] ..... D05B 97/00; B42B 1/02

[52] U.S. Cl. ..... 112/262.1; 112/222

[58] Field of Search ..... 112/262.1, 262.3, 21, 112/22, 2, 222

[56] References Cited

U.S. PATENT DOCUMENTS

| | | | |
|---|---|---|---|
| 671,530 | 4/1901 | Trebette | 112/21 |
| 1,236,762 | 8/1917 | Reynolds | 112/21 |

*Primary Examiner*—H. Hampton Hunter

*Attorney, Agent, or Firm*—Fishman and Van Kirk

[57] ABSTRACT

A device for thread stitching layers to form a book wherein the stitching apparatus comprises a conveying mechanism for transporting a plurality of open layers in spaced relation to each other, the conveying device transporting the layers with respect to at least one spiral sewing needle which is rotationally driven, the point of the spiral needle penetrating into the layer backs and exiting the layer backs to stitch the layers together in sequence.

9 Claims, 6 Drawing Figures

METHOD OF THREAD STITCHING LAYERS TO FORM A SEWN BOOK

This is a division of application Ser. No. 8,697, filed Feb. 1, 1979, now U.S. Pat. No. 4,252,071 dated Feb. 24, 1981.

BACKGROUND OF THE INVENTION (1) Field of the Invention

The present invention relates to the manufacture of books. More particularly, the present invention relates to the manufacture of sewn books.

(2) Description of the Prior Art

In the manufacture of books, two basic methods of book production have found acceptance: thread stitching of books and flexible binding of books. Both methods have conventional fields of application. The thread stitching method is typically used for the production of high quality books as well as reference books which are heavily stressed during use, that is, typically non-fiction books such as atlases, dictionaries and the like. The method of flexible binding is typically used in the making of inexpensive books such as telephone directories, catalogs and pocket books. Typically, the flexible binding method is used to manufacture books that are not stressed heavily during use.

Generally speaking, it is desirable to manufacture books by the thread stitching method since a book manufactured by the thread stitching method is more durable than one produced by the flexible binding method. However, the flexible binding method is often used instead of the thread stitching method because the thread stitching method is relatively expensive. Thus, the flexible binding method is useful particularly in the bulk production of novels. The novels must have the external presentation of a quality book but since there are no great requirements for its durability, the books are typically made by the flexible binding method. Thus, the heavy reliance on the flexible binding method for the production of books is due at least in part, to the expense of the conventional thread stitching method.

The conventional thread stitching method is carried on in such a manner that the processing speed of the book layers or signatures to form a sewn book is particularly low in comparison to the speed of other processing steps required to form a finished book. Restated, the conventional stitching phase of manufacturing method is much more time consuming than other phases of the manufacturing method such as back rounding, back lining, head banding and case working, the efficiency of which has been considerably improved. Thus, the difference in the processing speed of the stitching of the book layers together and the other steps in the manufacture of the books is enlarged. Because of the speed differential, the layers of the book must be sewn together and the sewn book must be stored and palletized prior to other phases of the manufacturing method.

It is an object of the invention to provide an efficient and economical apparatus for and method of thread stitching of layers or signatures to form a sewn book. Other objects will be apparent from the following description.

SUMMARY OF THE INVENTION

In accordance with the present invention, the layers of the book to be formed are placed in spaced apart relation and in the order corresponding to the book.

The layers are formed from one or more signature sheets which have been folded to form two pages connected by a back. The layers, preferably with their backs facing downwardly, are transported by cams on a conveying mechanism. The layers are transported in spaced apart relation and are positioned vertically. The opened layers are transported by the conveying mechanism to a sewing device comprising at least one and generally a plurality of rotating spiral sewing needles. The spiral needles have a point at one end and an eyelet at the other end for receiving and retaining thread. The backs of the opened layers are angled with respect to the longitudinal axis of the spiral needles by an angle defined by the helix angle of the spiral needle. As the spiral needle is rotated and an opened layer is moved in relation to the spiral needle, the point of the spiral needle penetrates the back of the layer and rotates into the space between the two pages of the layer. Upon further rotation of the spiral needle, the point of the needle once again penetrates and exits the back of the layer. The rotational speed of the spiral needle is a function of the advance speed of the layers and the spacing between the layers. Thus, as the layers move with respect to the rotating spiral needles, the layers are stitched together with the thread that is attached to the eyelet of the spiral needle.

After the spiral needles have rotated through a plurality of layers, the thread required to stitch further layers must be drawn through the sewn layers, that is, layers which already have been stitched. In order to reduce the tension on the thread and to prevent the thread from tearing the backs of the layers, the thread is drawn through the stitched layers at several points between the layers by a thread drawing mechanism. The threads are cut periodically to form a plurality of sewn layers that form the book. The layers are guided by the cams of the conveying device and are aligned at right angles and glued at the back.

It is advantageous to provide the backs of the layers with perforations so that the spiral needles may easily penetrate the backs. The perforations in the backs are set at a predetermined distance, that is, the perforations are coordinated with the positioning of the spiral needles as well as the stitch width of the spiral needles.

The thread stitching method of the present invention is particularly efficient since it provides for the rapid sewing of book layers. Because of the increased efficiency in the thread stitching method, the thread stitching method may now be coordinated in a production cycle for mass producing sewn books, that is, the thread stitching step may be a step between the highly mechanized steps of collating the layers and gluing the backs of the layers. Thus, sewn books having high quality binding may be manufactured efficiently. Other objects and advantages of the apparatus and method of the present invention will be apparent from the following detailed description of the invention with reference to the drawings.

DETAILED DESCRIPTION OF THE INVENTION

Figure 1:
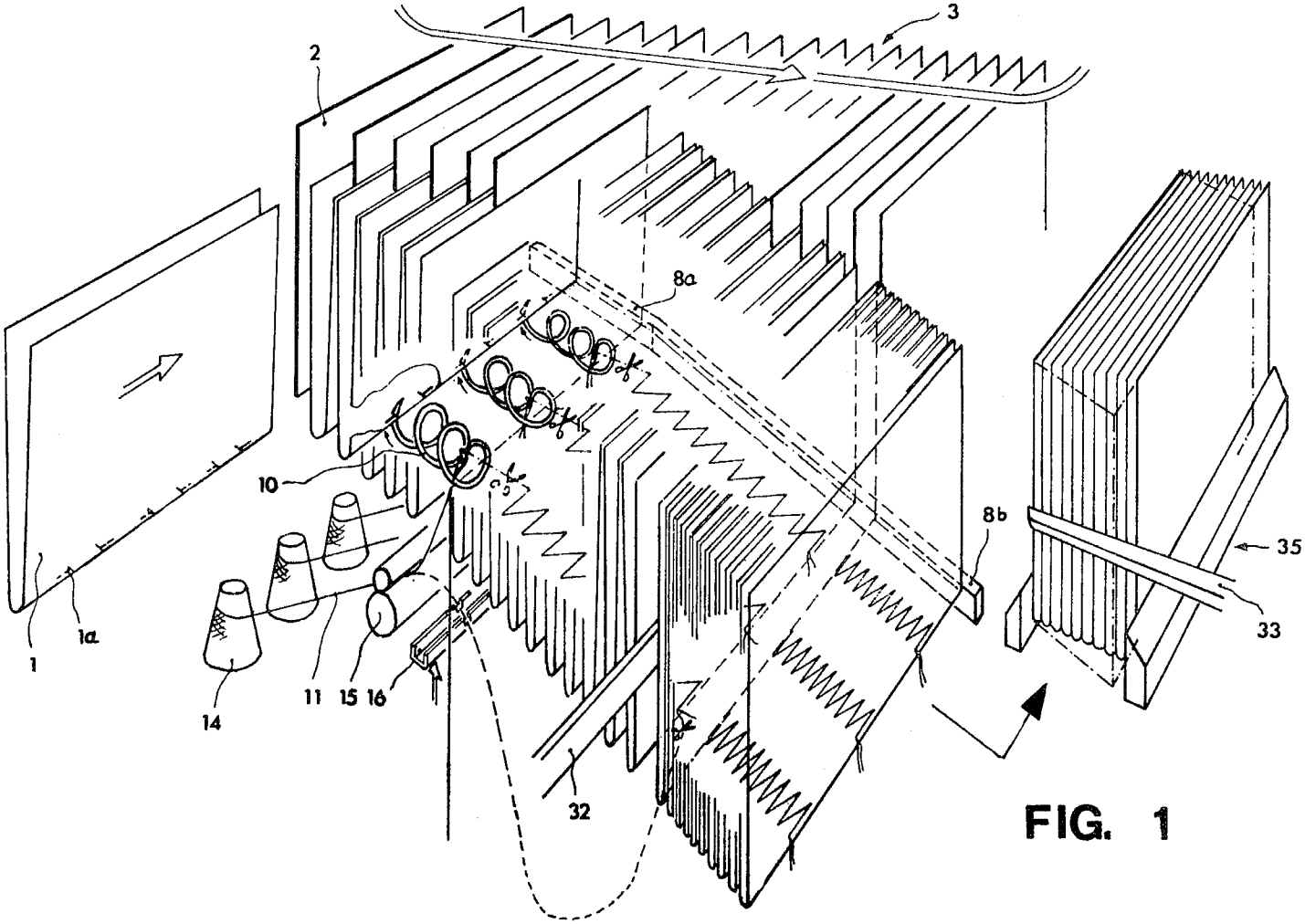
FIG. 1 is a simplified perspective view of an apparatus for the manufacture of books and includes the thread stitching apparatus as a portion of the book manufacturing apparatus.
Figure 2:
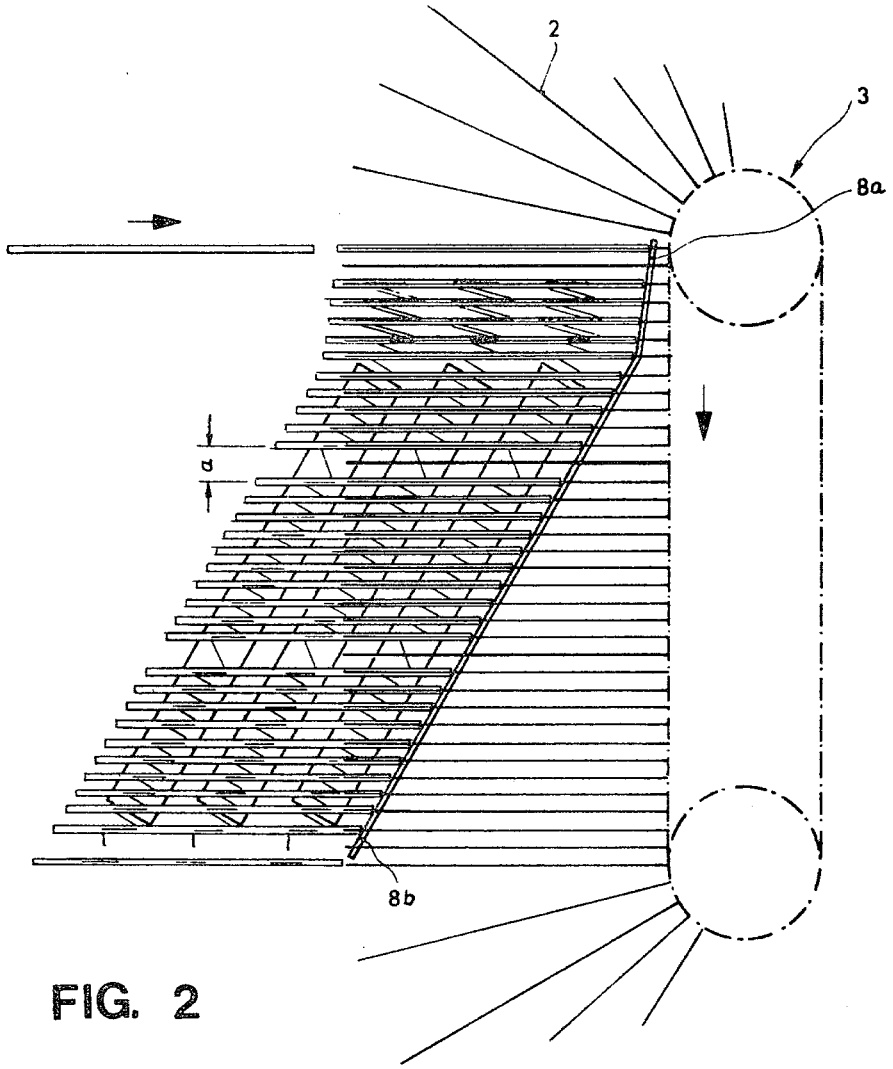
FIG. 2 is a schematic top view of the thread stitching apparatus.
Figures 3, 3A:
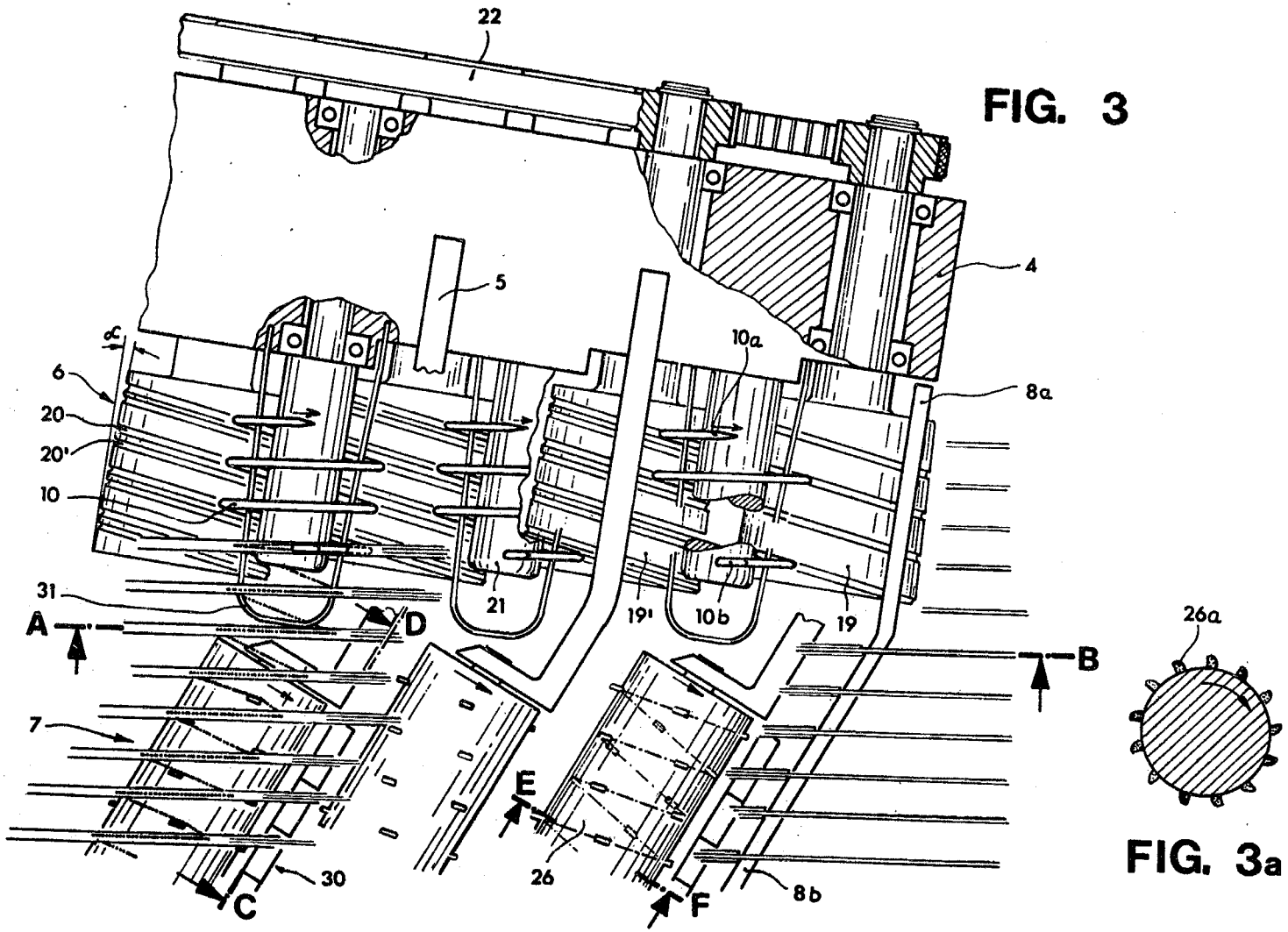
FIG. 3 is a partial top view of the thread stitching apparatus, various elements of the apparatus being omitted.
FIG. 3A is a sectional view along the line E-F in FIG. 3 of the thread drawing shaft.

Referring to FIGS. 1 and 2, book layers 1 comprise one or more signatures which have been folded to form two pages and a back. The book layers are delivered from a feeding device, that is, a collating machine and are centrally opened to provide a space between the pages of each layer. The collating machine and the manner by which the book layers 1 are centrally opened is not shown in the drawings. The layers are transported or fed in the direction shown by the arrow in FIGS. 1 and 2. The backs of the book layers face downwardly and the pages of the layers are in an upright or vertical position. A retaining sheet 2 is received by the space in each layer 1. Retaining sheets 2 of circular conveyor 3 are continuously moved in a direction shown by the arrows in FIGS. 1 and 2. The layers, when in a vertical position, are transported by the retaining sheets 2 of the conveyor 3. The elevated guides 5 form the bottom of the conveyor (see FIG. 3). Conveyor 3 moves the layers 1 through a sewing station 6 and then through a thread drawing station 7. During movement through the sewing station 6 and the thread drawing station 7, the front edges of the layers lie against layer guide 8 which extends in angular relation to the direction of the conveyance of the layers 1. Layer guide 8 is formed from two segments or stop gibs 8*a* and 8*b*. In the region of the thread drawing station 7, gib 8*a* is joined with gib 8*b*. Gib 8*b* is in angular relation to gib 8*a* and functions to guide book layers 1 away from the conveyor 3. As shown in FIGS. 2 and 3, the book layers 1 are gradually guided away from conveyor 3 and are released from retaining sheets 2 as the book layers approach the end of conveyor 3. The book layers 1 which have been sewn together move to another step or phase of the book manufacturing process.

As shown in FIG. 3, sewing station 6 comprises a plurality of spiral needles arranged side by side and positioned in the path of the moving book layers 1. The spiral needles are rotationally driven. Each spiral needle includes a point 10*a*, an eyelet 10*b* and defines a longitudinal central axis and a helix or spiral angle. The central axes of spiral needles 10 are tilted or angled with respect to the direction in which the book layers 1 move by an angle equal to the helix angle of the spiral needles 10. Referring to the spiral needle 10 located on the left side of the sewing station 6, because of the tilting of the longitudinal central axis of the spiral needle 10 by an angle equal to the helix angle of the spiral, the body of the needle 10 extends in parallel relation to the back of book layer 1. The helix angle and the rotational speed of spiral needles 10 is coordinated with the speed of advancement and the spacing of the book layers 1 in such a way that the spiral needles 10 pass through the back of each book layer 1. More specifically, points 10*a* of the spiral needles penetrate from the bottom into the backs of the book layers 1 and then exit downwardly from the backs of the book layers 1. Stitching thread 11 is retained in eyelets 10*b* of spiral needles 10. As the spiral needles 10 pass through the book layers 1, the stitching thread 11 is guided diagonally to each subsequent layer. The book layers 1 are sequentially stitched together by the thread which forms a zig-zag pattern.

As shown in FIG. 1, each spiral needle 10 is provided with a supply spool 14. The layers 1 are sewn together with double thread. The double thread is formed by drawing a predetermined length of thread from the spool 14. The length of thread is approximately four times the stitch distance. Feeding element 16 feeds the thread into eyelet 10*b* in a time controlled feeding sequence. Thus, as shown in the solid thread line 11 in FIG. 1, the thread is looped over eyelet 10*b* at the rear end of spiral needle 10. The spiral needles 10 are rotated and the book layers 1 are moved with respect to the needles. As the spiral needles sew through a plurality of book layers 1, the thread 11 is drawn from the spool 14 as shown by the dashed lines in FIG. 1. At the end of the stitching of a predetermined number of layers, the thread 11 is cut. As shown in FIG. 2, feed element 16 is inserted between the layers to insert a new thread. The feed element 16 is inserted in the space marked "a".

Unspooling of the thread 11 by rolls 15 can occur continuously during the sewing process in such a way that rolls 15 unspool a length of thread approximately four times the stitch distance. Thus, as shown in FIG. 1, when a predetermined number of layers have been sewn, the length of thread (shown in the dashed line) is that length necessary for the sewing of the subsequent predetermined number of layers. When the thread 11 is laid on the eyelet 10*b* by the feeding element 16, one part of the double thread has already been drawn from the spool 14 during the stitching of the previous predetermined number of layers. The other part of the double thread is drawn from spool 14 during the sewing process. Thus, the apparatus of the present invention is quite efficient in that there is no lost time for the unspooling of additional thread. Also, the passing of the stitching threads through the eyelet may be avoided.

As shown in FIG. 1, it may be advantageous with certain paper types to provide perforations in the backs of the layers 10 at points where the spiral needles pass through the backs. T-shaped or L-shaped perforations 10 have been found to be suitable.

Figure 4:
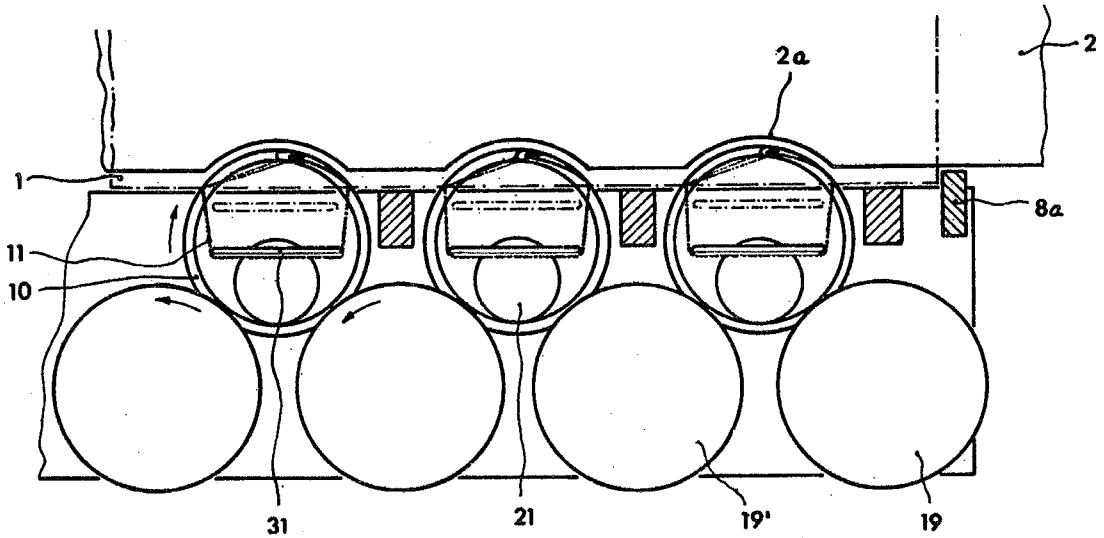
FIG. 4 is a simplified sectional view along the line A-B of the thread stitching apparatus shown in FIG. 3.

Referring to FIG. 4, a sectional view of the sewing station 6 is shown. The position of book layer 1 on retaining sheet 2 is shown. In order to securely maintain the back of the book layer 1 in position for penetration by the point 10*a* of the spiral needle 10, retaining sheet 2 must be positioned as close as possible to the interior side of the back of the book layer 1. In order to provide for close proximity of the retaining sheets 2 with respect to the backs of the book layers 1, sheets 2 are provided with recesses 2*a*. Recesses 2*a* receive spiral needles 10 as they rotate in the space between the sheets of each layer.

The mechanism for driving the spiral needles 10 will now be described. Each spiral needle 10 is driven by two rotating friction drive shafts 19 and 19'. The shafts 19 and 19' engage the periphery of the spiral needles 10 and include circumferential grooves 20 and 20' which run in a helical line. The helix angle of the helical line corresponds to the distance between the book layers and the core diameters of the shafts 19 and 19' correspond to the outside diameter of the spiral needles 10. Spiral needles 10 are in contact with the circumferential grooves 20 and 20'. In order to force the spiral needles 10 against drive shafts 19 and 19' a pressure shaft 21 is inserted in the interior of the spiral needle and applies pressure on the interior portions of the spiral needle 10. Friction drive shafts 19 and 19' and pressure shafts 21 are rotationally mounted in bearing block 4. Friction drive shafts 19 and 19' are driven by a drive motor (not shown) via a common toothed belt 22. The drive shafts 19 and 19' turn one revolution per passing of a book layer. As shown in FIG. 3, the central axles of friction drive shafts 19 and 19', the central axle of pressure shafts 21, and the center axes of spiral needles 10 as well as the stop gib 8*a* are in parallel arrangement.

In order to maintain spiral needles 10 in a certain position on friction drive shafts 19 and 19', that is, in order to prevent creeping of the spirals and slippage of the various elements, the core diameter of friction drive shafts 19 and 19' increases slightly by an angle of $\alpha$ as the drive shafts 19 and 19' approach the eyelets 10*b* of the spiral needles 10. Restated, the core diameter of friction drive shafts 19 and 19' is smaller in the region of point 10*a* of the spiral needle 10 and tapers by an angle $\alpha$ to a larger diameter near the eyelet 10*b* of the spiral needle 10. The spiral needles 10, guided through the circumferential grooves 20 and 20', tend to creep axially in the direction of travel of the book layers 1 because of the smaller core diameter compared with the periphery of the spiral needle. The spiral needles 10 return to the initial position because they are forced forward by the larger core diameter of the shafts 19 and 19'. The larger core diameter imparts a higher circumferential speed to the spiral needles 10. Thus, the spiral needles 10 finally remain in a stationary longitudinal position which corresponds exactly to the transmission ratio of 1 between the spiral outside diameter and the tapered drive shaft core diameter.

During the sewing process, as the double thread is drawn through a plurality of book layers 1, the tension on the thread in the sewn book layers tends to increase. By "sewn book layers", it is meant those layers which have already been stitched and through which additional thread must be drawn in order to sew additional layers at sewing station 6. With increased tension on the thread, the thread may cut into the backs of the book layers. In order to reduce the tension in the thread in the sewn book layers, the sewn layers are moved through a thread drawing station 7. The thread drawing station 7 includes a thread drawing shaft 26 positioned behind each spiral needle 10. The thread drawing shafts 26 are rotationally driven in the direction shown by the arrows in FIGS. 3 and 3*a*. One end of thread drawing shaft 26 is rotationally mounted in elevated guide 5, the guide forming the bottom limitation of conveyor 3 (see FIG. 3). The axis of the thread drawing shaft 26 is in parallel relation with the stop gib 8*b*. The second end of thread drawing shaft 26 is mounted in a bearing block (not shown). Thread drawing shafts are rotated in synchronized motion with the spiral needles via any conventional drive such as a toothed belt.

FIG. 3*a* shows a sectional view of a thread drawing shaft 26 having drawing cams 26*a* extending therefrom. Drawing cams 26*a* are distributed about the periphery of thread drawing shaft 26 and are located in a line extending helically around the thread drawing shaft 26. The distance between the cams 26*a* is coordinated with the distance between retaining sheets 2, the advancement speed of retaining sheets 2 and the inclination of thread drawing shafts 26 with respect to the retaining sheets 2 in such a way that drawing cams 26*a* move between the book layers 1. The drawing cams 26*a* engage the thread between successive book layers and move the thread diagonally against the direction of travel of the layers. The drawing of thread by cams 26*a* is carried out in such a wave-like rhythm that the thread is always drawn at the same time at every third layer. The next thread drawing impulse occurs each time at the following layer while at the preceding layer no thread drawing takes place so that the thread may be transported toward the spiral needles 10.

As previously mentioned, the book layers 1 are guided along the gib piece 8*b* of the layer guide 8. Gib 8*b* has an inclination such that the connecting threads of the book layers are tautened at adjoining or adjacen layers when a pile of layers is aligned at a right angle after the layers are released from the retaining sheets 2 of conveyor 3.

Figure 5:
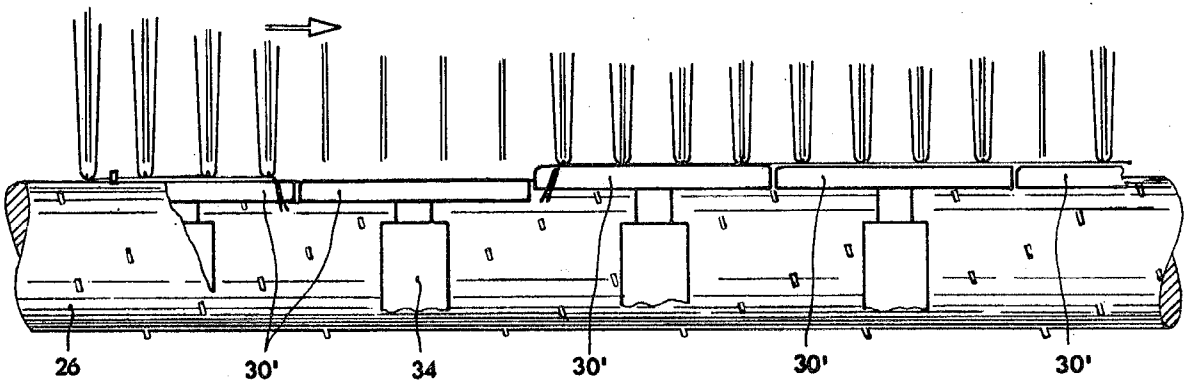
FIG. 5 is a sectional view along the line C-D of the thread stitching apparatus shown in FIG. 3.

Referring to FIGS. 3 and 5, in order to remove the stitched layers from the operation of thread drawing shafts 26 after the threading process has been carried out, the threaded book layers are lifted by two lifting gibs 30 which lie at a predetermined distance with respect to each other. The lifting gibs comprise a plurality of individual sectors 30'. The length of the lifting gibs 30 must be at least as long as the distance between the predetermined number of layers sewn by a given length of thread. Restated, the length of gibs 30 must be equal to or greater than the distance between thread cutters 36. After completion of the sewing of a predetermined number of layers, the lifting gibs 30 are moved jointly upwardly by pneumatic cylinder actuators 34. As shown in FIG. 5, the lifting sectors 30' form the bottom plane of the conveyor which lies above the cams 26*a* of the thread drawing shafts 26. On this plane, the book layers are transported away from circular conveyor 3. The various sectors 30' may be released by suitable control elements (not shown) after the layers have passed. Thus, the various sectors 30' are lowered into the initial position after the idle stroke of the apparatus has been completed and the cams 26*a* continue to draw thread through additional book layers.

As mentioned previously, the double thread is guided by eyelet 10*b* of spiral needle 10. The spiral needle 10 is not in a position to advance or draw the thread the length required per layer. To provide for advancement of the thread, a spring element 31 is inserted in the interior of the spiral needle 10. The spring element 31 has an elongated U-shape and the ends of the spring element 31 are mounted in bearing block 4. As can be seen in FIG. 4, the thread is guided by the spring element 31 during rotation of the spiral needle. Spring 31 is lifted by the thread against its spring action into the dash-dotted position shown in FIG. 4. The spring element 31 not only provides thread stock but also provides desirable tensile stress of the thread to allow for drawing of additional thread through the layers by thread drawing shafts 26.

As shown in FIG. 1, after a predetermined number of layers have been sewn and after the sewn layers 1 have left retaining sheets 2 of conveyor 3, the layers are separated from the row of layers by thread cutting or separating elements indicated schematically by small scissors at reference character 36. The layer blocks are then taken by a conveyor 32 and pressing blocks 37 to a pressing station 35. After the layers of the block have been aligned in conveyor 33, the block is pressed at its folding area. After the pressing process is carried out, the block is finally guided to a back gluing station.

It should be understood that the method and process of the present invention is not limited to the embodiment set forth in the detailed description of the invention. Numerous alterations may be made to the method and process as described without departing from the scope of the invention. For example, it may be desirable to maintain the layers in a stationary position and move the spiral needles in relation to the layers.

What is claimed is:

1. A method for thread stitching several layers to form a sewn book or the like, the layers comprising signature sheets folded to form a back, the method comprising:

conveying the layers in spaced apart parallel relation, the backs of said layers being aligned in a plane, said layers being moved in relation to at least one spiral needle;

rotating said spiral needle to provide for penetration and exiting of the backs of the layers by the spiral needle, said spiral needle being rotated at a speed and having a helix angle which is coordinated with the spacing and the speed of advancement of the layers, the spiral needle stitching the plurality of layers with thread to provide a plurality of sewn layers; and drawing the thread through the sewn layers at several points between the layers to reduce the tension of said thread.

2. A method according to claim 1 and further including perforating the backs of the layers before the backs are sewn with the spiral needle, said perforations being preset on said backs of said layers with reference to the edge of the layers, said perforations being coordinated with the position of the spiral needle as well as the stitch width of the spiral needle.

3. A method according to claim 2 wherein the backs of the layers are provided with T-shaped perforations.

4. A method according to claim 2 wherein the backs of the layers are provided with L-shaped perforations.

5. A method according to claim 2 wherein the edges of the layers are offset by an inclined guide gib and further including the step of aligning the edges of the layers.

6. A method according to claim 5 and further including separating the thread from the spiral needles after a predetermined number of layers are stitched together.

7. A method according to claim 6 and further including guiding the layers in serial order beyond the spiral needle.

8. A method acccording to claim 7 wherein the thread is retained by the end of the spiral needle.

9. A method according to claim 1 and further including forming loops at several points between the stitched layers.

* * * * *